United States Patent [19]

Harbulak et al.

[11] 4,052,254

[45] Oct. 4, 1977

[54] STRIPPING OF ELECTROPLATED NICKEL-IRON ALLOYS FROM FERROUS SUBSTRATES

[75] Inventors: Edward P. Harbulak, Allen Park; Ronald J. Lash, Warren, both of Mich.

[73] Assignee: M&T Chemicals Inc., Greenwich, Conn.

[21] Appl. No.: 654,403

[22] Filed: Feb. 2, 1976

Related U.S. Application Data

[63] Continuation-in-part of Ser. No. 602,140, Aug. 5, 1975, and Ser. No. 602,141, Aug. 5, 1975.

[51] Int. Cl.[2] ..... C23F 1/00

[52] U.S. Cl. ..... 156/664; 252/79.1

[58] Field of Search ..... 156/7, 18, 656, 664; 252/79.1, 79.4; 134/29; 75/97 R, 97 A, 119

[56] References Cited

U.S. PATENT DOCUMENTS

| | | | |
|---|---|---|---|
| 2,200,486 | 5/1970 | Burdick | 75/97 R |
| 3,102,808 | 9/1963 | Weisberg et al. | 75/97 R |
| 3,163,524 | 12/1954 | Weisberg et al. | 75/97 R |
| 3,460,938 | 8/1969 | Slominski et al. | 75/97 R |
| 3,583,867 | 6/1971 | Slominski et al. | 75/119 |
| 3,717,520 | 2/1973 | Brinidisi | 156/18 |
| 3,958,984 | 5/1976 | Fountain | 156/656 |

*Primary Examiner*—Charles E. Van Horn

*Assistant Examiner*—Jerome W. Massie, IV

*Attorney, Agent, or Firm*—Kenneth G. Wheeless; Robert P. Auber; Robert Spector

[57] ABSTRACT

A composition and process for selectively removing nickel-iron alloys from a metal substrate which comprises contacting said metal surface with an aqueous bath containing:

a. at least one nitro substituted organic compound containing at least one solubilizing group;
b. at least one organic amine or polyamine or substituted amine or polyamine;
c. at least one aliphatic carboxylic acid or salt thereof, or a compound which will yield said carboxylic acid or salt thereof in solution, further characterized in that said aliphatic carboxylic acid or salt thereof additionally contains at least one substituent group selected from $—NH_2$ or quaternary amine salts thereof, —OH, or —SH; and
d. at least one phosphorus oxo acid or organic phosphorus oxo acid or salts thereof or alkyl phosphonate substituted amines.

By nickel-iron alloy deposit is meant a deposit containing from about 5 to 90 percent by weight iron with that portion which is not iron being primarily nickel or nickel and cobalt. Although small amounts of impurities such as copper, zinc, cadmium, lead, etc. may also be present, the major constituents of the alloy are nickel and iron.

55 Claims, No Drawings

STRIPPING OF ELECTROPLATED NICKEL-IRON ALLOYS FROM FERROUS SUBSTRATES

This application is a continuation in part of U.S. applications Ser. Nos. 602,140 and 602,141, each filed Aug. 5, 1975.

This invention relates to compositions and methods for stripping nickel-iron alloys from metal substrates, particularly from steel substrates.

BRIEF DESCRIPTION

This invention is a composition and process for selectively removing nickel-iron alloys from a metal substrate which comprises contacting said metal surface with an aqueous bath containing:

a. at least one nitro substituted organic compound containing at least one solubilizing group;
b. at least one organic amine or polyamine or substituted amine or polyamine;
c. at least one aliphatic carboxylic acid or salt thereof, or a compound which will yield said carboxylic acid or salt thereof in solution, further characterized in that said aliphatic carboxylic acid or salt thereof additionally contains at least one substituent group selected from $—NH_2$ or quaternary amine salts thereof, —OH, or —SH; and
d. at least one phosphorus oxo acid or organic phosphorus oxo acid or salts thereof or alkyl phosphonate substituted amines.

By nickel-iron alloy deposit is meant a deposit containing from about 5 to 90 percent by weight iron with that portion which is not iron being primarily nickel or nickel and cobalt. Although small amounts of impurities such as copper, zinc, cadmium, lead, etc. may also be present, the major constituents of the alloy are nickel and iron.

BACKGROUND OF THE INVENTION

Ever since it has been possible to electroplate objects, it has been desirable to be able to remove the electroplated deposit in order to salvage those objects which might have been unsatisfactorily plated. In the case of nickel plating, a number of methods for removing nickel deposits can be found in the technical and patent literature. However, with the recent introduction of commercially acceptable bright nickel-iron alloy electrodeposits (as for example exemplified by U.S. Pat. Nos. 3,795,591 and 3,806,429 to Clauss et al. or 3,804,726 to Passal), the stripping methods which had been successful for removing nickel deposits have proved to be ineffective in removing nickel-iron alloy deposits. Thus, it has not been possible to easily, rapidly or satisfactorily remove these new decorative nickel-iron deposits. This invention describes a method for the rapid and efficient removal of nickel-iron deposits, so that objects which for one reason or another have been unsatisfactorily plated with a nickel-iron alloy, may be stripped of the nickel-iron alloy deposit and salvaged.

Heretofore, it has been possible to strip nickel deposits (whether electrodeposits or electroless) from a ferrous basis metal such as steel or iron because the nickel deposit was sufficiently different chemically and/or electrochemically from the ferrous basis metal so that the stripping action was confined to the nickel deposit and did not attack the ferrous basis metal. However, with the introduction of commercially successful nickel-iron alloy deposits, particularly those with substantial proportions of iron (e.g. 5% or more), the deposit is more chemically and/or electrochemically similar to the ferrous basis metal on which the nickel-iron alloy may be electrodeposited. Thus, those strippers which might be able to dissolve and strip the nickel-iron alloy deposit, cannot differentiate between a ferrous basis metal and the deposit, and thus also dissolve and attack the ferrous basis metal with subsequent damage and/or destruction of the ferrous object which it is desired to strip. Conversely, those stripping solutions which heretofore have successfully been used to strip nickel are ineffective in stripping the new nickel-iron alloy deposits. As a result, a satisfactory method for stripping nickel-iron alloy electrodeposits has not been available.

DETAILED DESCRIPTION

This invention is a composition and process for selectively removing nickel-iron alloys from a metal substrate which comprises contacting said metal surface with an aqueous bath containing:

a. at least one nitro substituted organic compound containing at least one solubilizing group:
b. at least one organic amine or polyamine or substituted amine or polyamine;
c. at least one aliphatic carboxylic acid or salt thereof, or a compound which will yield said carboxylic acid or salt thereof in solution, further characterized in that said aliphatic carboxylic acid or salt thereof additionally contains at least one substituent group selected from $—NH_2$ or quaternary amine salts thereof, —OH, or —SH; and
d. at least one phosphorus oxo acid or organic phosphorus oxo acid or salts thereof or alkyl phosphonate substituted amines.

By nickel-iron alloy deposit is meant a deposit containing from about 5 to 90 percent by weight iron with that portion which is not iron being primarily nickel or nickel and cobalt. Although small amounts of impurities such as copper, zinc, cadmium, lead, etc. may also be present, the major constituents of the alloy are nickel and iron.

Typical nitro substituted organic compounds are mono or poly nitro substituted benzene rings containing one or more solubilizing groups such as carboxylic or sulfonic acids, etc., for example:

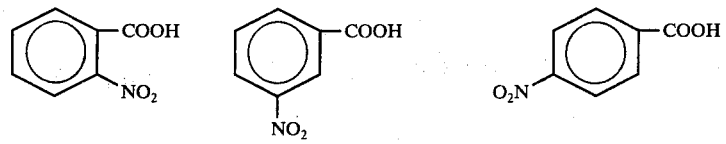

o-nitrobenzoic acid m-nitrobenzoic acid p-nitrobenzoic acid

-continued

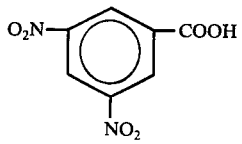
3,5-dinitrobenzoic acid

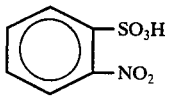
o-nitrobenzene sulfonic acid

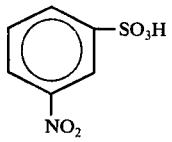
m-nitrobenzene sulfonic acid

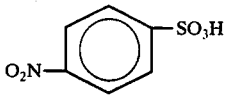
p-nitrobenzene sulfonic acid

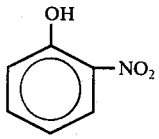
o-nitrophenol

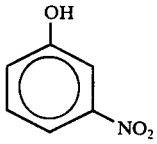
m-nitrophenol

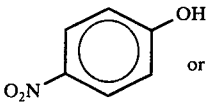
or
p-nitrophenol

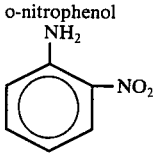
o-nitroaniline

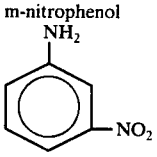
m-nitroaniline

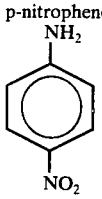
p-nitroaniline

It is understood that salts of the above acids may be used instead of the free acid, for example, $Na^+$, $K^+$, $Li^+$, $NH_4^+$, etc.

Of the above compounds, para- and meta-nitrobenzoic acid are particularly advantageous because of their efficacy and ready commercial availability.

Typical operable organic amines or polyamines or substituted amines or polyamines are exemplified by the following list:

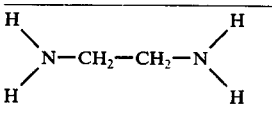
ethylenediamine

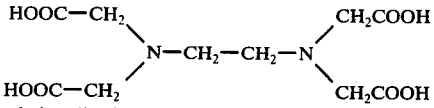
ethylenediaminetetraacetic acid

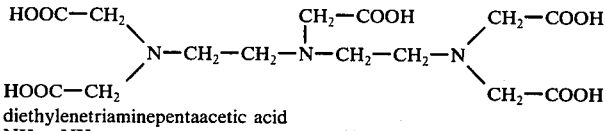
diethylenetriaminepentaacetic acid

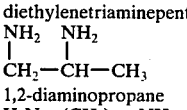
1,2-diaminopropane

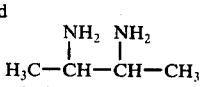
2,3-diaminobutane $H_2N-(CH_2)_3-NH_2$
1,3-diaminopropane

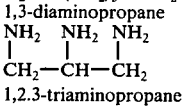
1,2.3-triaminopropane

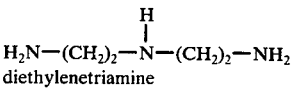
diethylenetriamine

It is understood that salts of the above acids or quaternary salts of the amine groups may be used instead of the free acid or amine.

Of the above compounds, ethylenediamine and ethylenediaminetetraacetic acid are especially useful.

Substituted carboxylic acids or salts thereof, of the type proposed for item "c" are aliphatic mono or poly carboxylic acids containing at least one substituent where the substituent groups are selected from one or more of the following:

$-NH_2$, or quaternary amine salts thereof (such as $-NH_3^+Cl^-$), —OH or —SH. Typical examples of suitable substituted carboxylic acids or salts thereof are:

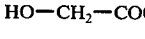
glycolic acid

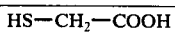
thioglycolic acid

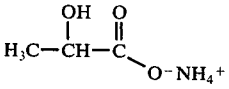
ammonium lactate

-continued

| | | |
|---|---|---|
| 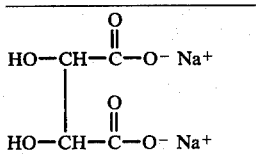 sodium tartrate | $H_2N-CH_2-COOH$ glycine | 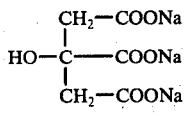 sodium citrate |
| 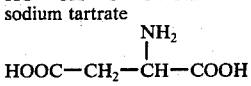 aspartic acid | 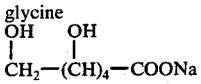 sodium gluconate | 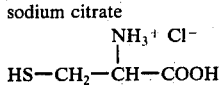 cysteine hydrochloride |

The operable phosphorus oxo anions as their acids or salts are the phosphates, condensed phosphates such as pyrophosphate and other polyphosphates, as well as the organic phosphates, phosphonates, phosphinates and alkyl phosphonate substituted amines. Typical examples of suitable phosphorus oxo anions include:

| | |
|---|---|
| 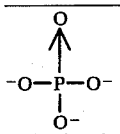 Orthophosphate | 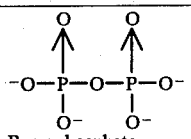 Pyrophosphate (dipolyphosphate) |
| 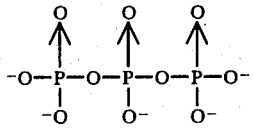 Tripolyphosphate | 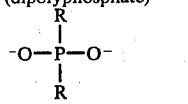 Organic Phosphonate* |
| 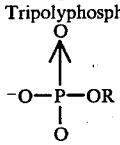 Organic Phosphate* | 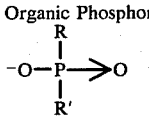 Organic Phosphinate** |

*Where R is aryl or substituted aryl or straight or branched chain alkyl with up to eight carbon atoms.
**Where R and R' are independently selected from aryl or substituted aryl or straight or branched chain alkyl with up to eight carbon atoms.

Of the above typical substituted carboxylic acids or salts thereof, citric acid, or citrate salts, glycine and its salts and lactic acid or lactate salts are especially useful in the operation of this invention.

It is understood that suitable cations are required along with the above anions to provide charge neutrality. For example, hydrogen, sodium, potassium, lithium, ammonium, etc.

Of the above typical phosphorus oxo compounds, ortho phosphoric acid or its various salts and pyrophosphoric acid or its various salts are especially useful in the operation of this invention.

A combination of at least one compound selected from each of the following groups, *a, b, c,* and *d,* will effectively remove a nickel-iron alloy deposit from a ferrous object, without etching, dissolving or attacking said ferrous object.

In order to strip or remove a nickel-iron alloy deposit containing up to about 90% iron from a ferrous basis metal according to the various aspects of this invention, it is necessary to prepare an aqueous solution, selecting at least one ingredient from each of the following classes of materials:

a. A nitro substituted organic compound further characterized in that it contains at least one solubilizing group.
b. An organic amine, polyamine or substituted amine or polyamine.
c. An aliphatic carboxylic acid or salt thereof, or a compound which will give said carboxylic acid or salt thereof in solution, further characterized in that it additionally contains at least one substituent group selected from $-NH_2$, or quaternary amine salts thereof, —OH or —SH.
d. A phosphorus oxo acid or organic phosphorus oxo acid or salts thereof or alkyl phosphonate substituted amines.

The purpose of the nitro substituted organic compounds of group (a) (a good example being para-nitrobenzoic acid) is to oxidize the nickel-iron alloy deposit. Suitable concentration ranges for the organic nitro compounds may be from about 0.015–2.2 moles/l, preferably about 0.06–1.5 moles/l and most preferred about 0.1 to 0.8 moles/l.

The organic amine or polyamines of group (b) function as complexing agents for the nickel ions, provide a buffering action to stabilize the pH of the solution and, most importantly, are active in preventing etching of a ferrous basis metal which otherwise might be attacked by the organic nitro compounds. Operable concentration ranges for the organic amines or polyamines are from 0.015 to 7 moles/l, preferably about 0.03 to 5 moles/l and most preferred 0.05 to 4 moles/l.

The aliphatic carboxylic acids of group (c) function as complexing agents for the oxidized nickel and iron and thus to help solubilize the nickel and iron ions and assist in their removal from the surface of the deposit so that the organic nitro oxidizing agents can function efficiently. Operable concentration ranges for the carboxylic acids or salts thereof are from 0.06 moles/l to saturation, preferably about 0.13 to 5 moles/l and most preferred about 0.19 to 4 moles/l.

The phosphorus oxo acids or salts thereof of group (d) are believed to function as complexing agents for the oxidized metals of the deposit and thus to help solubilize the nickel and iron and/or cobalt ions and assist in their removal from the surface of the deposit so that the organic nitro oxidizing agents can function efficiently. Suitable concentration ranges for the phosphorus oxo acids or salts thereof may be from about 0.05 moles/l to saturation, preferably about 0.1 to 5 moles/l and most preferred about 0.3 to 2 moles/l.

Since the chemical reaction proceeds more rapidly at higher temperatures, it is advantageous to operate the nickel-iron stripping solutions of this invention at elevated temperatures. In addition, when using the various ingredients at the higher concentration ranges, limited solubility may require operation at above room temperatures. Suitable temperatures may range from about 30° C. to boiling. Boiling solutions, however, evaporate rapidly thus necessitating frequent additions of water as well as posing other problems; therefore, a range of 60° to 90° C. provides a useful compromise which gives an efficient rate of stripping without excessive loss of solution or other attendant problems of boiling solutions.

The pH of the solution has an important role in the efficient operation of this invention. If the pH is below about 7, the stripping action of the solution is not impaired; however, the basis metal may etch as it becomes exposed to the oxidizing action of the organic nitro compounds. Conversely, if the pH is about 13 or higher, the stripping action may be completely inhibited. Therefore, the pH is desirably maintained between about 6 to 13 and preferably between about 7 to 12. The pH may be adjusted by appropriate additions of acids and bases. For example, sulfuric or hydrochloric acid and sodium or ammonium hydroxide may be conveniently used to lower or raise the operating pH of the stripping solution. It is also advantageous to measure the pH of the solution at the operating temperature.

Although this invention has been described in terms of stripping a nickel-iron deposit from a ferrous basis metal, it will be readily apparent to those skilled in the art that brass or copper or other copper alloys can also serve as a suitable basis metal for nickel-iron alloy deposits. Since these metals may be readily etched by the action of the stripping solutions described herein, it is advantageous to additionally include inhibitors to the formulations of this invention. These inhibitors are most suitably sulfur compounds of the type listed in U.S. Pat. No. 3,102,808. Typical examples are diethyldithiocarbamate, thiourea, sodium sulfide, etc.

The following examples will further serve to illustrate the operation of this invention to those skilled in the art. However, these examples are not meant to limit the scope of the invention.

EXAMPLE 1

An aqueous solution was prepared according to the following formulation:

| | |
|---|---|
| meta-nitrobenzoic acid | 0.5 moles/1 |
| ethylenediamine | 0.75 moles/1 |
| sodium citrate dihydrate | 0.5 moles/1 |
| potassium orthophosphate (dibasic) | 0.3 moles/1 |
| pH adjusted to | 9.5 electrometric |

A nickel-iron alloy electrodeposit containing 42% iron and plated to an average thickness of 8 microns, directly on steel, was immersed in the above solution at a temperature of 80° C. The deposit was completely stripped off within about one hour with no attack on the basis metal.

EXAMPLE 2

An aqueous solution was prepared according to the following formulation:

| | |
|---|---|
| para-nitrobenzoic acid | 0.48 moles/1 |
| ethylenediamine | 0.75 moles/1 |
| citric acid (anhydrous) | 0.52 moles/1 |
| potassium pyrophosphate | 0.39 moles/1 |
| pH adjusted to | 9.35 electrometric |

A nickel-iron electrodeposit containing about 29% iron plated to a thickness of 8 microns directly on steel was immersed in the solution at 80° C for 1 hour. At the end of this time the deposit was completely stripped from the basis steel leaving a clean, etch-free surface.

Although this invention has been described with reference to specific examples, it will be apparent that various modifications may be made thereto which fall within the scope of this invention.

We claim:

1. A process for selectively removing nickel-iron alloys from the surface of a ferrous metal substrate which comprises contacting said metal surface with an aqueous bath containing in the absence of any inhibitor to prevent corrosive attack on the substrate:

a. at least one nitro substituted organic compound containing at least one solubilizing group;

b. at least one organic amine or polyamine or substituted amine or polyamine;

c. at least one aliphatic carboxylic acid or salt thereof, or a compound which will yield said carboxylic acid or salt thereof in solution, further characterized in that additionally said aliphatic carboxylic acid or salt thereof contains at least one substituent group selected from $—NH_2$, or quaternary amine salts thereof, or —OH; and d. at least one phosphorus oxo acid or organic phosphorus oxo acid or salts thereof or alkyl phosphonate substituted amines.

2. The process of claim 1 wherein said nitro substituted organic compound is a nitrobenzoic acid.

3. The process of claim 1 wherein said nitro substituted organic compound is a nitrobenzene sulfonic acid.

4. The process of claim 1 wherein said nitro substituted organic compound is a nitrophenol.

5. The process of claim 1 wherein said nitro substituted organic compound is a nitroaniline.

6. The process of claim 1 wherein said organic amine is ethylenediamine.

7. The process of claim 1 wherein said organic amine is ethylenediaminetetraacetic acid.

8. The process of claim 1 wherein said organic amine is diethylenetriaminepentaacetic acid.

9. The process of claim 1 wherein said organic amine is 1,2-diaminopropane.

10. The process of claim 1 wherein said organic amine is 2,3-diaminobutane.

11. The process of claim 1 wherein said organic amine is 1,3-diaminopropane.

12. The process of claim 1 wherein said organic amine is 1,2,3-triaminopropane.

13. The process of claim 1 wherein said organic amine is diethylenetriamine.

14. The process of claim 1 wherein said aliphatic carboxylic acid is glycolic acid.

15. The process of claim 1 wherein said aliphatic carboxylic acid is lactic acid.

16. The process of claim 1 wherein said aliphatic carboxylic acid is tartaric acid.

17. The process of claim 1 wherein said aliphatic carboxylic acid is glycine.

18. The process of claim 1 wherein said aliphatic carboxylic acid is citric acid.

19. The process of claim 1 wherein said aliphatic carboxylic acid is aspartic acid.

20. The process of claim 1 wherein said aliphatic carboxylic acid is gluconic acid.

21. The process of claim 1 wherein said aliphatic carboxylic acid is cysteine.

22. The process of claim 1 wherein said nickel-iron alloy contains from 5 to 90% iron.

23. The process of claim 1 wherein said phosphorus oxo moiety exhibits an orthophosphate anion.

24. The process of claim 1 wherein said phosphorus oxo moiety exhibits a pyrophosphate anion.

25. The process of claim 1 wherein said phosphorus oxo moiety exhibits a tripolyphosphate anion.

26. The process of claim 1 wherein said phosphorus oxo moiety exhibits a formula

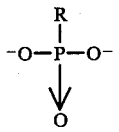

where R is selected from the group consisting of aryl, substituted aryl, and straight or branched alkyl of fewer than nine carbon atoms.

27. The process of claim 1 wherein said phosphorus oxo moiety exhibits the formula:

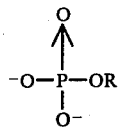

wherein R is selected from the group consisting of aryl, substituted aryl, and straight or branched chain alkyl of fewer than nine carbon atoms.

28. The process of claim 1 wherein said phosphorus oxo moiety exhibits the formula:

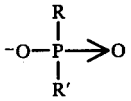

wherein R and R′ are each independently selected from the group consisting of aryl, substituted aryl, and straight or branched chain alkyl of fewer than nine carbon atoms.

29. A composition for selectively stripping nickel-iron alloys from the surface of a ferrous metal substrate which comprises an aqueous bath containing in the absence of any inhibitor to prevent corrosive attack on the substrate:

a. from 0.015 moles per liter to 2.2 moles per liter of at least one nitro substituted organic compound containing at least one solubilizing group;
b. from 0.015 moles per liter to 7 moles per liter of at least one organic amine, polyamine or substituted amine or polyamine;
c. from 0.13 moles per liter to 5.0 moles per liter of at least one aliphatic carboxylic acid or salt thereof, or a compound which will give said carboxylic acid or salt thereof in solution, characterized in that said aliphatic carboxylic acid or salt thereof contains at least one substituent group selected from —$NH_2$, or quaternary amine salts thereof, or —OH; and
d. from 0.13 moles per liter to 5.0 moles per liter of at least one phosphorus oxo acid or organic phosphorus oxo acid or salts thereof or alkyl phosphonate substituted amines.

30. The composition of claim 29 wherein said nitro substituted organic compound is a nitrobenzoic acid.

31. The composition of claim 29 wherein said nitro substituted organic compound is a nitrobenzene sulfonic acid.

32. The composition of claim 29 wherein said nitro substituted organic compound is a nitrophenol.

33. The composition of claim 29 wherein said nitro substituted organic compound is a nitroaniline.

34. The composition of claim 29 wherein said organic amine is ethylene diamine.

35. The composition of claim 29 wherein said organic amine is ethylenediaminetetraacetic acid.

36. The composition of claim 29 wherein said organic amine is diethylenetriaminepentaacetic acid.

37. The composition of claim 29 wherein said organic amine is 1,2-diaminopropane.

38. The composition of claim 29 wherein said organic amine is 2,3-diaminobutane.

39. The composition of claim 29 wherein said organic amine is 1,3-diaminopropane.

40. The composition of claim 29 wherein said organic amine is 1,2,3-triaminopropane.

41. The composition of claim 29 wherein said organic amine is diethylenetriamine.

42. The composition of claim 29 wherein said aliphatic carboxylic acid is glycolic acid.

43. The composition of claim 29 wherein said aliphatic carboxylic acid is lactic acid.

44. The composition of claim 29 wherein said aliphatic carboxylic acid is tartaric acid.

45. The composition of claim 29 wherein said aliphatic carboxylic acid is glycine.

46. The composition of claim 29 wherein said aliphatic carboxylic acid is citric acid.

47. The composition of claim 29 wherein said aliphatic carboxylic acid is aspartic acid.

48. The composition of claim 29 wherein said aliphatic carboxylic acid is gluconic acid.

49. The composition of claim 29 wherein said aliphatic carboxylic acid is cysteine.

50. The composition of claim 29 wherein said phosphorus oxo moiety exhibits an orthophosphate anion.

51. The composition of claim 29 wherein said phosphorus oxo moiety exhibits a pyrophosphate anion.

52. The composition of claim 29 wherein said phosphorus oxo moiety exhibits a tripolyphosphate anion.

53. The composition of claim 29 wherein said phosphorus oxo moiety exhibits a formula:

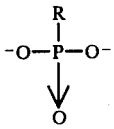

where R is selected from the group consisting of aryl, substituted aryl, and straight or branched alkyl of fewer than nine carbon atoms.

54. The composition of claim 29 wherein said phosphorus oxo moiety exhibits the formula:

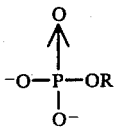

wherein R is selected from the group consisting of aryl, substituted aryl, and straight or branched chain alkyl of fewer than nine carbon atoms.

55. The composition of claim 29 wherein said phosphorus oxo moiety exhibits the formula:

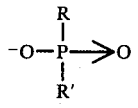

wherein R and R′ are each independently selected from the group consisting of aryl, substituted aryl, and straight or branched chain alkyl of fewer than nine carbon atoms.

* * * * *